United States Patent [19]

Bäckström

[11] Patent Number: 4,643,673

[45] Date of Patent: Feb. 17, 1987

[54] BURNER SYSTEM AT HEATING UNIT

[76] Inventor: Holger G. Bäckström, Trosalundsgatan 11A, S-150 13 Trosa, Sweden

[21] Appl. No.: 557,187

[22] PCT Filed: Mar. 17, 1983

[86] PCT No.: PCT/SE83/00096

§ 371 Date: Nov. 17, 1983

§ 102(e) Date: Nov. 17, 1983

[87] PCT Pub. No.: WO83/03459

PCT Pub. Date: Oct. 13, 1983

[30] Foreign Application Priority Data

Mar. 30, 1982 [SE] Sweden ..... 8202043

[51] Int. Cl.[4] ..... F23D 5/02

[52] U.S. Cl. ..... 431/340; 431/338; 126/93

[58] Field of Search ..... 431/262, 260, 338, 339, 431/340, 342; 165/76, 78; 236/10; 126/163 R, 163 A, 147, 146, 96, 95, 93, 15 R

[56] References Cited

U.S. PATENT DOCUMENTS

| | | | |
|---|---|---|---|
| 1,776,150 | 9/1930 | Ebke | 431/338 |
| 2,194,135 | 3/1940 | Breese | 431/340 |
| 2,194,136 | 3/1940 | Breese | 431/340 |
| 2,226,455 | 12/1940 | Wegner | 431/340 |
| 2,231,151 | 2/1941 | Breese et al. | 431/340 |
| 2,252,162 | 8/1941 | Breese | 431/340 |
| 2,258,679 | 10/1941 | Hayler | 431/340 |
| 2,265,797 | 12/1941 | Bresse et al. | 431/340 |
| 2,287,361 | 6/1942 | Suchland | 431/340 |
| 2,302,287 | 11/1942 | Behrendlt | 431/340 |
| 2,316,226 | 4/1943 | Donley | 431/340 |
| 2,353,439 | 7/1944 | Bresse et al. | 431/340 |
| 2,406,865 | 10/1946 | Mackaye | 431/338 |
| 2,569,877 | 10/1951 | Woodruff | 236/10 |
| 2,654,423 | 10/1953 | Gilmore et al. | 431/340 |
| 3,304,984 | 2/1967 | Hellmann | 431/339 |

FOREIGN PATENT DOCUMENTS

| | | | |
|---|---|---|---|
| 148864 | 11/1950 | Australia | 431/260 |
| 1116854 | 11/1961 | Fed. Rep. of Germany | 431/260 |
| 1078561 | 5/1954 | France | 431/340 |
| 0005228 | 1/1979 | Japan | 431/340 |
| 0000235 | 1/1979 | Japan | 431/338 |
| 625855 | 7/1949 | United Kingdom | 431/340 |

*Primary Examiner*—Margaret A. Focarino
*Assistant Examiner*—H. A. Odar
*Attorney, Agent, or Firm*—Nies, Webner, Kurz & Bergert

[57] ABSTRACT

A burner system, for example at a heating unit, comprising a burner of evaporation type for liquid fuel, for example Diesel oil, where fuel is intended via an inlet (5) to be supplied into a combustion space, preferably at the bottom (3) thereof, which combustion space preferably is substantially cylindric and open at the end (4) opposite to said bottom (3), and where preferably an ignition member (6), for example a glowing filament, is provided for the initial ignition of evaporated fuel, and where means (9,16,17,18) are provided for the supply of air to the combustion space. The burner system is particularly characterized in that at least one turbulence generating member, a turbulator (10), for example in the form of a central piece (11) or the like with blades, wings (12) or the like substantially radially projecting therefrom is located substantially perpendicularly to the longitudinal, vertical axis of the combustion space and substantially in parallel with said bottom (3), thereby dividing the combustion space into a lower space (13) and an upper space (14), and whereby an intimate mixing of air and fuel vapour is achieved at the passage past the turbulator (10). A further characterizing feature is that a first ring of apertures (15) or the like for the supply of air to said lower space (13) extends substantially in the circumferential direction of the wall (1) of the combustion space, and in a corresponding manner at least one additional, a second ring of apertures (16,17,18) or the like is provided for the supply of air to said upper space (14).

12 Claims, 4 Drawing Figures

BURNER SYSTEM AT HEATING UNIT

Figure 1:
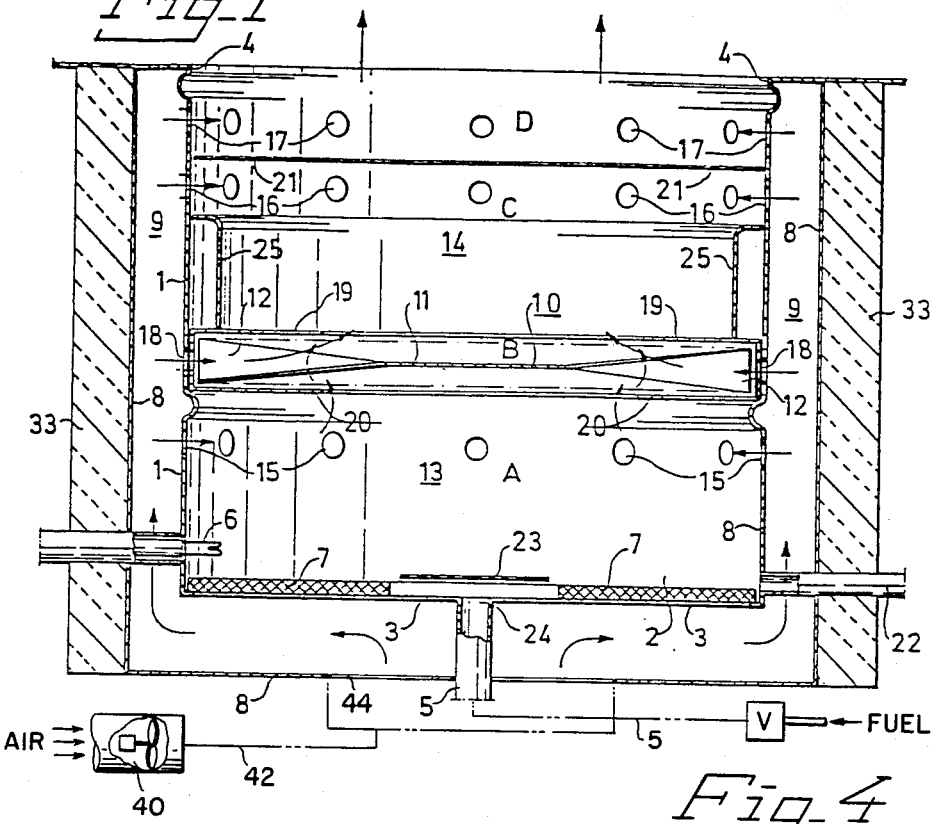

This invention relates to a burner system of evaporation type for liquid fuels, for example Diesel oil, where fuel is intended to be supplied via an inlet into a combustion space, preferably at one end thereof, and where an ignition member, for example a glowing filament, is provided to initiate evaporation and ignite the fuel, and where means for the supply of air to the combustion space are provided.

The burner according to the invention is intended to be used, for example, at heating units for heating boats, caravans etc. Burners of this type and for this purpose are known previously. One problem with known burners is that a substantial fan capacity is required for achieving an intimate mixing between the gasified fuel and the combustion air supplied. This is, of course, a serious problem, for example at leisure boats, in view of their relatively low battery capacity for fan operation.

A further problem with known burners is coking at the fuel inlet as it can disturb the fuel supply. Coking is caused by the combustion taking place in substantially direct contact with the inlet. Known burners, moreover, have very poor control properties, and in most cases on-off control with constant air and fuel supply is used, which implies a permanent high consumption of electric energy at operation.

The burner according to the present invention is designed so that are aforesaid problems are eliminated or substantially reduced. With the burner, for example, an extremely intimate mixing of gasified fuel with air is obtained without high fan capacity, whereby the electric energy demand is reduced substantially. The combustion, further, takes place at full capacity separated from said inlet. The control capacity, besides, compared with known burners is good. The special design of the burner also prevents "growling" combustion noise, which usually occurs at known burners.

The present invention, thus, relates to a burner system, for example at heating units, comprising a burner of evaporation type for liquid fuel, for example Diesel oil, where fuel is intended to be supplied via an inlet into a combustion space, preferably at the bottom thereof, which combustion space preferably is substantially cylindric and open at the end opposite to said bottom, and where preferably an ignition member, for example a glowing filament, is provided to initiate the ignition of gasified fuel, and where means for the supply of air to the combustion space are provided.

The burner system according to the invention is particularly characterized in that at least one turbulence generating member, a turbulator, for example in the form of a central piece or the like, with blades, wings or the like projecting substantially radially therefrom, is located substantially perpendicularly to the longitudinal axis, vertical axis of the combustion space and substantially in parallel with said bottom, thereby dividing the combustion space into a lower and an upper space and effecting an intimate mixing of air and fuel vapour at the passage past the turbulator, that a first ring of apertures or the like extending substantially in the circumferential direction of the combustion space is provided for supplying air to said lower space, and that in a corresponding manner at least one additional, second, ring of apertures or the like is provided for supplying air to said upper space.

Figure 4:
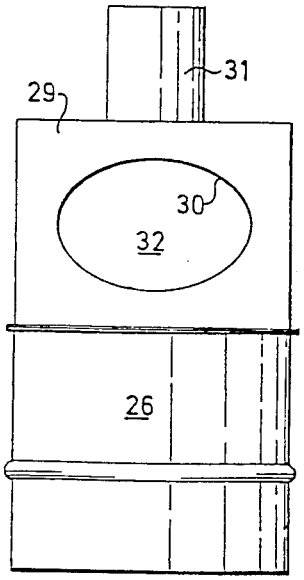
Figure 3:
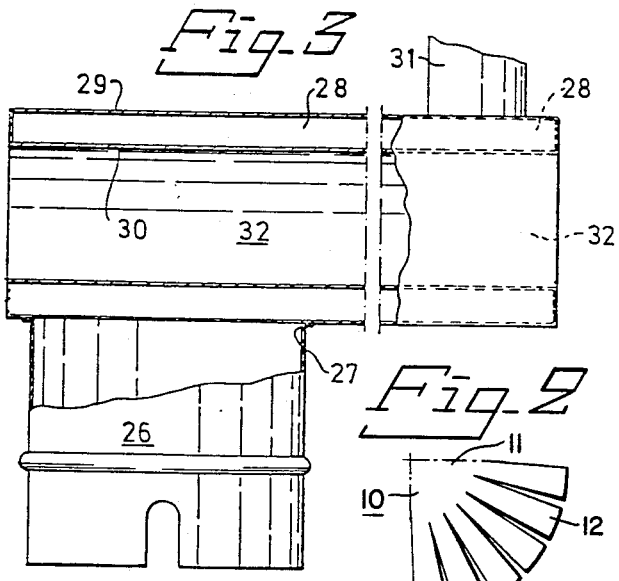
Figure 2:
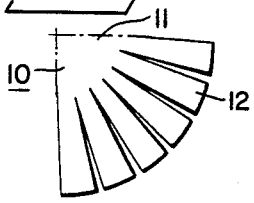

The invention is described in greater detail in the following, with reference to one embodiment thereof and to the accompanying drawing, in which FIG. 1 is a schematic vertical central section through an embodiment of a burner according to the invention, FIG. 2 shows a quarter of an embodiment of a turbulator according to the invention, FIG. 3 is a partially sectional vertical view of a heat exchanger for a burner according to the invention, and FIG. 4 is a view from the left in FIG. 3 of a heat exchanger according to FIG. 3.

In FIG. 1 the shell surface or wall of a combustion space comprised in the burner according to the invention is designated by 1. Said combustion space preferably is substantially cylindric and comprises at one end, its lower end 2 a bottom 3. At its other end 4 opposite to said bottom, the combustion space is open. The burner is of the evaporation type and intended for liquid fuels, for example Diesel oil or paraffin-oil. An inlet 5 for the supply of fuel to the combustion space, according to a preferred embodiment, is located centrally at said bottom 3. The numeral 6 designates an ignition member, for example a glowing filament, which is located adjacent the wall 1 and bottom 3, and the numeral 7 designates a wick of preferably glass fibre or corresponding material, which is located adjacent the bottom 3 and extends from the ignition member 6.

For the supply of air, i.e. combustion air, to the combustion space, according to a preferred embodiment a casing 8 is provided, which encloses at least the shell surface 1 of the combustion space. Air is intended to be supplied via the space 9 formed between the casing 8 and said shell surface 1, as will be explained in greater detail below.

In FIGS. 1 and 2 the numeral 10 designates a turbulence generating member, a turbulator, which according to the invention comprises wings or blades 12 or corresponding members, which project from a disc-shaped central piece 11 or the like. The blades 12 preferably are designed twisted in such a manner, that the plane of the blades coincides with the plane of the central piece 11 adjacent the same and forms an angle of about 45° with said central piece adjacent the wall 1, to which the blades extend. The turbulator is located substantially perpendicularly to the longitudinal, vertical axis of the combustion space and substantially in parallel with the bottom 3, thereby dividing the combustion space into a lower space 13 and an upper space 14, whereby air and fuel vapour are intermixed intimately when they are passing from said lower space 13 to said upper space 14.

According to the invention at least two rings, a first one and a second one, of apertures or the like extend substantially in the circumferentially direction of the wall 1, through which apertures air is supplied to the combustion space. A first ring of apertures 15 is located beneath the turbulator 10 to supply air to said lower space. According to a preferred embodiment, a second ring of apertures 16 is located above the turbulator 10 distinctly spaced therefrom, a third ring of apertures 17 is located above said second ring of apertures 16, and a fourth ring of apertures 18 is located substantially directly in front of and on the same level as the turbulator 10.

According to the invention, two substantially annular discs or the like, viz. a first upper disc 19 and a second lower disc 20, extend in the circumferential direction of the combustion space and project from the wall thereof.

Said discs are located in connection to the turbulator 10 substantially in parallel therewith and above and, respectively, beneath the same, as shown in FIG. 1.

Preferably also a third ring 21 is located in said upper space 14 in a corresponding way as said first and second rings 19,20 between said second and said third ring of apertures 16,17, i.e. at a considerable distance from the first ring 19, where the inner diameter of the third ring 21 preferably slightly exceeds the inner diameter of at least the first ring 19.

In FIG. 1 the numeral 22 designates a drainage outlet for surplus fuel which is located in connection to said bottom 3 and preferably adjacent the wall 1. 23 designates a radiation protection member in the form of a disc 23 located above the opening 24 of the inlet 5.

Preferably also a casing 25 extends in the circumferential direction of the combustion space between said first ring 19 and said second ring of apertures 16, which casing constitutes a radiation protection member.

According to a preferred embodiment, the rings 19,20,21, the turbulator 10 and the radiation protection member 25 are coherent in a suitable manner and can be removed as one unit from the burner.

For the supply of air, a fan 40 or the like is provided, by means of which an air amount substantially constant per time unit is intended to be supplied to the combustion space. Furthermore, a valve V or the like is provided for controlling the fuel amount supplied per time unit via the fuel inlet 5.

In FIGS. 3 and 4, the numeral 26 designates a cylindric hood or the like, into which the burner is intended to be inserted from below and be fixed therein. Said hood 26 is connected at its upper end 27 to one end of an oblong space 28 formed between an outer, preferably substantially parallelepipedic casing 29 and an inner cylindric casing 30 with circular, elliptic or similar cross-section. Into said space 28 combustion gases and surplus air from the burner are intended to be introduced and to flow therein, whereafter they go off through a waste gas valve, a chimney 31, at the other end of the space. Air or water found in the cylindric hollow space 32 formed inside of the casing 30 are intended hereby to be heated by heat exchange.

The burner, heat exchanger, fan etc. preferably are arranged in a common container (not shown), so that a heating unit is obtained which even in respect of its outer appearance is expedient.

The mode of operation of the burner system according to the invention should substantially have become appearent from the aforesaid. Depending among other things on the energy output from the burner, the combustion takes place in different zones in the vertical direction of the combustion space, which zones are indicated approximately by A,B,C and D in FIG. 1. The boundary line between the zones, of course, varies.

Into zone A, which substantially corresponds to said lower space 13, the fuel is introduced, and a relatively small amount thereof evaporates therein at the initial ignition. Via the apertures 15 air is supplied so that ignition by the glowing filament 6 or the like can be effected. The developed effect is very low. In operation, when more fuel per time unit is evaporated, the air admixture in zone A is too poor, and the burner flame moves to zone B.

In zone B evaporated fuel is mixed intimately with air by means of the turbulator 10, which deflects fuel vapour and air and causes the gas mixture to rotate. Additional air is supplied, via the fourth ring of apertures 18, and due to the rings 19, 20, in a direction substantially across the flow direction of the deflected gas mixture. Owing to the aforesaid design of the turbulator blades 12, the air supplied penetrates deep into the gas mixture flow, due to the so-called Coanda-effect. At operation with relatively low energy output, the combustion takes place substantially in zone B and substantially with a blue flame. At additional increase of the energy output by supplying a greater amount of fuel per time unit, the flame changes its appearance to being bright and is located within zones B and C.

At maximum or almost maximum energy output, the combustion takes place in zones C and D with a bright flame and heavy turbulence. Owing to the intimate mixing between fuel vapour and air, brought about among other things by the turbulator, growling combustion noise is prevented. A bright flame is desired because it yields a high effect by its high proportion of radiation, which is taken up effectively by the surfaces of the heat exchanger, primarily the outer surface of the casing 30.

The total amount of air supplied per time unit, as already mentioned, is substantially constant while the energy output is controlled by adjusting the fuel supply. The air supply in the zones C and D assists in increasing the control range in respect of energy output in such a manner, that at low effect the combustion gases are cooled and diluted and thereby the effect transferred to the heat exchanger is reduced.

The turbulator, in addition to its mixing function, also serves as a radiation protection member, which at high effect decreases the heat radiation downward into zone A. This implies a higher temperature in the combustion zone (C and D) and reduces the heat load at the fuel inlet 24. Hereby the risk of coking at the fuel inlet is eliminated, and thereby the central arrangement is rendered possible. Due to the central arrangement, a certain inclination of the burner in operation can be permitted, which is an essential feature when the burner is installed in boats. The turbulator also has the function of a flame holder at low effect, so that, due to the nearness of the flame, a sufficient amount of radiation heat for evaporating the fuel is supplied to zone A.

The radiation protection member 25 in zone C results in an increase of the combustion temperature. High combustion temperature generally is desired in order to achieve a more complete combustion and to reduce the content of carbon monoxide and aromatic hydrocarbons in the waste gases. The insulation 33, FIG. 1, also has the object to some extent to reduce the energy amount going off from the combustion space.

As should have become apparent from the aforesaid, the burner system according to the invention offers several advantages, for example noiseless combustion, a wide control range in respect of energy output, low energy demand due to intimate mixing of fuel vapour and air by the turbulator.

The invention has been described above with reference to one embodiment. Variants and minor changes, of course, can be imagined without abandoning the invention idea. Thus, more than one turbulator can be employed, in which case, for example, an additional turbulator is positioned in a way corresponding to FIG. 1. The turbulator, further, may be designed more complicated than stated above, so that the air-fuel mixture is deflected several times.

The burner system and the burner according to the invention, of course, can be used as a heat generating component in units of other types where heat generation is required, for example in refrigerators, air-conditioning units etc.

The invention, thus, must not be regarded restricted to the above embodiment, but can be varied within the scope of the attached claims.

What is claimed is:

1. A burner assembly comprising a burner of evaporation type for liquid fuel, said assembly comprising a substantially cylindrical combustion chamber having a cylindrical wall and a bottom, and having a fuel inlet at its lower end and being open at the opposite end; the assembly also including: an ignition member for initial ignition of evaporated fuel; a turbulator for generating turbulence, said turbulator being located at an intermediate region of the combustion chamber, thereby dividing the combustion chamber space into a lower space and an upper space, said turbulator extending substantially perpendicular to the axis of the combustion chamber and comprising a central member having a plurality of circumferentially arranged radially projecting surfaces and being constructed and arranged so that intimate mixing of air and fuel vapour is effected by passage past said projecting surfaces of said turbulator from the lower to the upper space; and two annular discs which extend in the circumferential direction of the combustion space and project from the wall; which discs extend adjacent to and substantially parallel with the turbulator, one on either axial side thereof; the wall of the combustion chamber has at least four circumferential rings of apertures arranged to supply air into, respectively, the lower space, the upper space, and the region of the turbulator between the annular discs so that the air thus supplied into said region is conveyed radially towards the center of the turbulator and thereby mixed intimately with a mixture of fuel vapour and air passing the turbulator; and at least a third annular disc in the upper space, arranged similarly to said first two discs and spaced above and apart from the upper one thereof; the wall of the combustion chamber having a circumferential ring of apertures at either axial side of the third disc.

2. A burner assembly according to claim 1 wherein said plurality of projecting surfaces on the central member of the turbulator are provided by a plurality of radial blades.

3. A burner assembly according to claim 1, wherein the inner diameter of the third disc exceeds the inner diameter of at least the upper one of the first two said discs.

4. A burner assembly according to claim 1, having an outer casing defining a space between itself and said cylindrical wall, providing a flow passage for an air supply to said combustion chamber.

5. A burner assembly according to claim 1, having means for supplying air to the combustion chamber at a substantially constant rate, and means connected to said fuel inlet for controlling the rate of supply of fuel in order to control the heat output of the burner assembly.

6. A burner assembly according to claim 1, wherein the fuel inlet is located centrally at the bottom of the combustion chamber.

7. A burner assembly according to claim 1, having a drain outlet for surplus fuel adjacent the bottom of the combustion chamber.

8. A burner assembly according to claim 1 wherein the turbulator comprises at least one disc-shaped central piece from which said projecting surfaces are blades projecting radially, each blade extending from the central piece to the wall of the combustion chamber and being shaped so that, adjacent the disc central piece, it is co-planar therewith, whereas adjacent the wall of the combustion chamber it is at an angle of about 45 degrees to the disc-shaped central piece.

9. A burner system according to claim 1, wherein a wick material is provided and located adjacent said bottom of the combustion chamber extending from said ignition member substantially to said drain outlet, said ignition member being located adjacent the wall and the bottom of the combustion chamber and said drain outlet being essentially diametrically located relative to the ignition member, said wick having an opening above said fuel inlet whereby the wick is adapted to be soaked by fuel before excess fuel leaves the combustion chamber through the drain outlet.

10. A burner system according to claim 1, wherein a radiation shield protection member is provided and is mounted adjacent and over the fuel inlet to protect said fuel inlet from radiated heat from the combustion chamber.

11. A burner assembly according to claim 1, having a casing which extends circumferentially within the combustion chamber between the upper one of said discs and said ring of apertures for the upper space, said casing serving as a radiation shield member.

12. A burner assembly according to claim 11, wherein said annular discs, and turbulator, and said casing are made coherent in a suitable manner so as to be removable as a unit from the combustion chamber.

* * * * *